United States Patent [19]

Yasuda et al.

[11] 4,105,740

[45] Aug. 8, 1978

[54] PROCESS FOR THE PRODUCTION OF POLYESTER FIBER

[75] Inventors: Hiroshi Yasuda, Otsu; Katsuya Tani, Shiga; Jiro Nagatamo, Otsu, all of Japan

[73] Assignee: Toyo Boseki Kabushiki Kaisha, Japan

[21] Appl. No.: 536,644

[22] Filed: Dec. 26, 1974

[30] Foreign Application Priority Data

Dec. 26, 1973 [JP] Japan ..... 48-3896

[51] Int. Cl.[2] ..... D02J 1/22

[52] U.S. Cl. ..... 264/290 T; 264/210 F

[58] Field of Search ..... 264/176 F, 210 F, 290 T

[56] References Cited

U.S. PATENT DOCUMENTS

| | | | |
|---|---|---|---|
| 2,952,879 | 9/1960 | Kitson et al. | 269/290 T |
| 3,448,573 | 6/1969 | Glen et al. | 264/290 T |
| 3,527,862 | 9/1970 | Shimosako et al. | 269/290 T |
| 3,539,680 | 11/1970 | Fukushima et al. | 269/290 T |
| 3,567,817 | 3/1971 | Spiller | 264/290 T |
| 3,771,307 | 11/1973 | Petrille | 57/157 TS |
| 3,772,872 | 11/1973 | Piazza et al. | 57/157 TS |
| 3,816,994 | 6/1974 | Small | 57/157 TS |
| 3,832,436 | 8/1974 | Harris et al. | 269/290 T |
| 3,886,722 | 6/1975 | Hori et al. | 57/157 TS |
| 3,894,135 | 7/1975 | Riggert et al. | 264/290 T |
| 3,936,999 | 2/1976 | Ikeda et al. | 57/157 TS |
| 3,987,136 | 10/1976 | Schippers | 264/103 |

FOREIGN PATENT DOCUMENTS

| | | | |
|---|---|---|---|
| 1,050,393 | 12/1966 | United Kingdom | 264/290 T |

*Primary Examiner*—Jay H. Woo

*Attorney, Agent, or Firm*—Wenderoth, Lind & Ponack

[57] ABSTRACT

Stretching polyester tows at a speed greater than 150 m/min., wherein more than 85 mol percent of the recurring units are units of ethylene terephthalate, is carried out at a stretch ratio satisfying the formula $$-1.58\log(\Delta n \times 10^3) + 4.18 \leqq DR \leqq -2.32\log(\Delta n \times 10^3) + 5.93$$

wherein $\Delta n$ represents the birefringence of the unstretched filaments and is a value of from 0.020 to 0.100, and DR is the stretch ratio in times.

12 Claims, 1 Drawing Figure

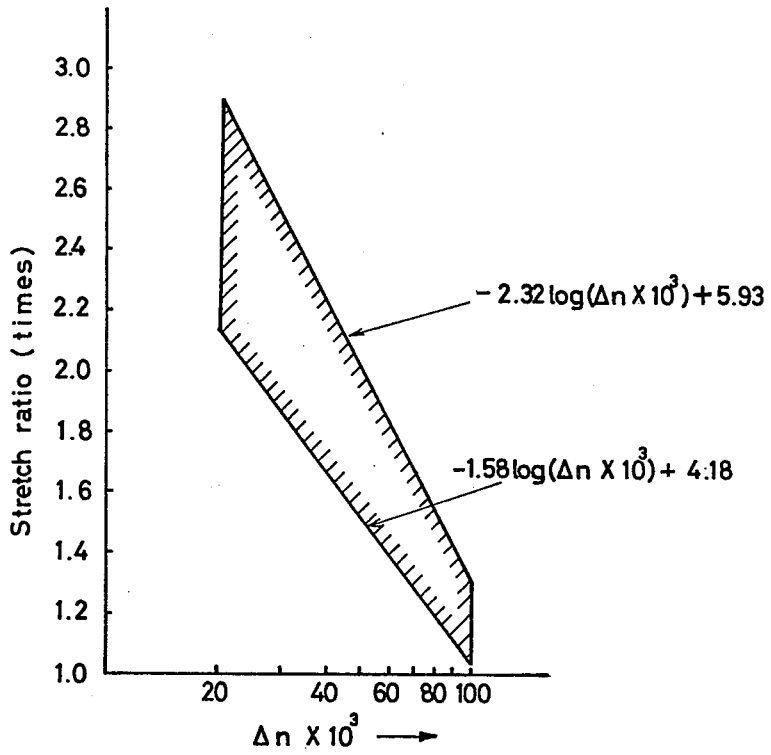
3.0
2.8
2.6
2.4
2.2
2.0
1.8
1.6
1.4
1.2
1.0
Stretch ratio (times)
20
40
60
80
100
Δn X 10³
− 2.32 log(Δn X 10³) + 5.93
−1.58 log(Δn X 10³) + 4.18

PROCESS FOR THE PRODUCTION OF POLYESTER FIBER

The present invention relates to a process for the production of a polyester fiber, and more particularly to a process for the high speed stretching of a polyester tow for use in staple fibers.

As the stretching techniques for the production of polyester fibers, there are known stretching techniques for multifilament yarns and stretching techniques for tows. The former is intended for a fine yarn of several hundred deniers at most, composed of several tens of filaments, and the latter is intended for a fiber bundle in the form of a ribbon or band of several hundred to several million deniers. In respect to the stretching of multifilament yarn, a great number of technical improvements have been made, and as regards the stretching speed, while it was initially about 300 to 500 m/min., a higher speed on the order of 1,000 to 1,500 m/min. has recently been attained. On the other hand, much effort has been made on the technical improvement of tow stretching, but the stretching speed still remains as low as 120 to 140 m/min. at the highest, and it has been a task of extreme difficulty to carry out stretching at a higher speed to obtain a polyester fiber of commercial merit for use in staple fibers.

In view of such present situation, we made an intensive study to develop a high speed stretching technique for polyester tows for use in staple fibers. As a result, we have achieved the present invention wherein the stretching is carried out at a high speed above 150 m/min., especially above 180 m/min. to produce a stretched polyester tow of commercial merit.

Thus the present invention provides a process for the production of polyester fiber, characterized by melt-spinning a polyester in which more than 85 mol percent of the recurring units are composed of ethylene terephthalate, into filaments of high orientation such that the birefringence $\Delta n$ of the unstretched filaments after spinning becomes 0.020 to 0.100, bundling the resulting filaments into the form of a tow and then subjecting the tow to high speed stretching at a stretch ratio shown in the following formula:

$$-1.58\log(\Delta n \times 10^3) + 4.18 \leqq DR \leqq -2.32\log(\Delta n \times 10^3) + 5.93$$

wherein $\Delta n$ represents the birefringence of unstretched filaments and DR represents the stretch ratio (times).

The invention will be further explained as follows partly by referring to the accompanying drawing which is a graphic representation showing the stretching region according to this invention, wherein the ordinate shows stretching ratio and the abscissa represents the birefringence $\Delta n \times 10^3$ of unstretched filaments on a logarismic scale.

The polyesters to which the present invention is applicable are those in which more than 85 mole percent of the recurring units are composed of ethylene terephthalate, and among them more preferable are polyethylene terephthalates produced from terephthalic acid or a functional derivative thereof and ethylene glycol. However, the polyesters may be such copolymers wherein a part of terephthalic acid or a functional derivative thereof is replaced with at least one bifunctional acid selected from, for example isophthalic acid, adipic acid, sebatic acid, azelaic acid, naphthalic acid, p-oxybenzoic acid, 2,5-dimethylterephthalic acid, bis-p-carboxyphenoxyethane, 2,6-naphthalenedicarboxylic acid, 3,5-di(carbomethoxy)benzenesulfonic acid, their alkali metal salts and their functional derivatives, as an acid component, to the extent of less than 15 mol percent, preferably less than 10 mol percent; or they may be such copolymers wherein a part of ethylene glycol is replaced with at least one dihydric alcohol selected from for example diethylene glycol, propylene glycol, 1,4-butanediol, and 1,4-hydroxymethylcyclohexane, as a glycol component, to the extent of less than 15 mol percent, preferably less than 10 mol percent. Of course, such polyesters may contain an antioxidant, delustering agent, coloring agent, flame retardant, dye-receptivity improving agent, etc. The intrinsic viscosity of such polymers is not particularly limited, and it is sufficient to employ polymers having such an intrinsic viscosity as generally used for tow stretching (for example an intrinsic viscosity of about 0.35 to 0.70 as measured at 30° C. in a mixed solvent of phenol and tetrachloroethane in the ratio of 6:4).

The high speed stretching as referred to in the present invention means to stretch unstretched filaments, obtained by the melt-spinning of the above-mentioned polyester, bundled in the form of a tow, at a tow takeup speed after stretching of about 150 m/min., especially above 180 m/min., more preferably above 200 m/min. to from 500 to 600 m/min. The attainment of filaments of commercial merit by stretching the polyester tow at such a high speed becomes possible only by satisfying the integral and undividable requirements of this invention, i.e. the polyester should be melt-spun into filaments of high orientation such that the birefringence $\Delta n$ of unstretched filaments after spinning becomes 0.020 to 0.100 and the filaments bundled in the form of a tow should be stretched at the stretching ratio represented by the foregoing formula.

As concrete means for the melt-spinning of the polyester into filaments of high orientation such that the birefringence $\Delta n$ of the unstretched filaments after spinning becomes 0.020 to 0.100, there may be recited various methods including a method wherein the takeup speed of the extruded filaments is brought to a high speed above 2,000 to 3,000 m/min.; a method wherein the spinning draft (the ratio of the takeup speed of extruded filaments to the average flow rate of the polymer passing through spinnerette orifices) is heightened by increasing the diameter of the spinnerette orifices; a method wherein the spinning temperature is lowered as much as possible; and a method wherein the cooling conditions for extruded filaments are made more severe. Of course, these means may be variously combined. In the present invention, among these means, it is particularly recommended that highly oriented unstretched filaments having the above-mentioned birefringence be produced by the high speed spinning method above 2,000 to 3,000 m/min., from the viewpoint of improved productivity. Such high speed spinning in combination with the high speed stretching according to the present invention can produce such a surprising effect that the productivity will be increased to at least two times the usual productivity, or 4 to 8 times under favorable conditions, or 15 to 20 times in some cases.

In the present invention, it is necessary to use unstretched filaments which, after spinning, have a birefringence $\Delta n$ in the range of 0.020 to 0.100, and for obtaining a good stretchability a range of 0.025 to 0.070 is particularly recommended. If the birefringence of the unstretched filaments is less than 0.020, filament breaking due to the disorder in the bundled form of the tow will occur frequently to make it difficult to obtain products of commercial merit, and at the same time it will become impossible to prevent filament breakage due to a sharp rise of the tow tension at the start of the high speed stretching and at the restart after shutdown. On the other hand, it is difficult to spin unstretched filaments having a birefringence in excess of 0.100, as a matter of fact it is nearly impossible to provide such filaments as a tow for use in staple fibers. The unstretched filaments are then bundled in the form of a tow, which is then subjected to high speed stretching. Preferably the tow has several tens × 10,000 deniers to several hundreds × 10,000 deniers.

For the stretching in the present invention, it is necessary to carry out stretching at the stretching ratio shown by the formula previously mentioned, for the stretching method, conventional methods used in polyester tow stretching may be employed, that is to say, a one-stage or multistage stretching method, in which hot plates, steam or hot air current heated to above the secondary order transition point of the polymer, or a suitable combination of these is used. Among these, particularly preferred is a one-stage stretching method in which a steam jet and hot plates are combined. In the present invention, it is suitable to set the stretching temperature above 100° C., preferably at a high temperature between 120° C. and 230° C., and it is particularly desirable to employ a higher stretching temperature as the birefringence of unstretched filaments becomes greater. When highly oriented filaments are stretched at such a high temperature, orientation crystallization will occur simultaneously with the stretching, thereby giving stretched filaments of low shrinkability which are suitable for use as woven fabrics having small residual strain.

Also, to obtain stretched filaments of low shrinkability, it is preferable to use the dry stretching method in which heat loss due to latent heat of evaporation is small.

For the stretching ratio in the present invention, it is necessary to set it between the upper limit $-2.32\log(\Delta n \times 10^3) + 5.93$ and the lower limit $-1.58\log(\Delta n \times 10^3) + 4.18$, as previously mentioned. Stretching at a larger ratio than this upper limit will cause frequent breaking of single filaments to worsen the product quality, and at the same time will cause frequent occurrence of filament entanglement about rollers to lower the operation efficiency. Also, stretching at a smaller ratio than this lower limit will produce unstretched residual parts, giving larger denier fluctuation and larger dyeing unevenness, and it becomes difficult to obtain stretched filaments having desirable strength-elongation characteristics for use in spun yarn.

The annexed drawing is a graphic representation showing the relation between the stretch ratio according to the present invention shown by the previously mentioned formula and the birefringence $\Delta n$ of unstretched filaments. The ordinate shows stretch ratio (times) and the abscissa shows the birefringence $\Delta n \times 10^3$ of unstretched filaments on a logarismic scale. The portion surrounded by slanting lines is the stretch region of the present invention.

After the stretching, the tow passes through the steps of definite length- and/or relaxation-heat treatment, mechanical crimping, heat-setting, oiling, cutting, etc. and is finally packed up. In the conventional stretching of polyster tows, it has been impossible to obtain fibers having a prescribed percent shrinkage unless the length of the definite length- or relaxation-heat treatment apparatus is increased as the stretching speed is increased. But in the present invention, since the tow after stretching has a far smaller percent shrinkage than that of conventional ones, the definite length heat treatment after the stretching is almost unnecessary, or even if necessary, an apparatus of short length is sufficient, which is an advantage of the present invention.

Thus, the present invention makes it possible to produce stretched polyester tows of commercial merit by stretching the tows at much higher speed than the conventional speed. Therefore, the contribution of the present invention to the improvement in the productivity of polyester fibers is great.

The invention will be further explained by means of the following Examples which are given for illustration purpose only and not for limiting the scope of the invention.

EXAMPLE 1

A polyethylene terephthalate having an intrinsic viscosity [η] of 0.6 (measured in a mixed solvent of phenol and tetrachloroethane in the ratio of 6:4, at 30° C.) was extruded at a spinning temperature of 290° C., through a spinnerette having 300 extrusion orifices, each 0.25 mm. in diameter, provided in circular arrangement. The extruded filaments were cooled rapidly just below the spinnerette by a cool air current blown thereagainst at the flow rate of 0.4 m/sec., from the entire surface surrounding the filaments. Thereafter, the cooled and solidified filaments were wound on a winder. By varying the extrusion amount of the polymer and the winder takeup speed, six kinds of unstretched yarns (Samples A to F) shown in Table 1 were obtained.

Table 1

| Sample | Extrusion amount of polymer (g/min.) | Winder takeup speed (m/min.) | Birefringence Δn of the unstretched yarn |
|---|---|---|---|
| A | 178 | 1,000 | 0.006 |
| B | 208 | 1,550 | 0.012 |
| C | 250 | 2,000 | 0.021 |
| D | 250 | 2,500 | 0.028 |
| E | 284 | 2,900 | 0.037 |
| F | 291 | 3,200 | 0.042 |

These unstretched yarns were then each bundled to form a tow of one million deniers, respectively, and the tows were stretched at the stretching speed of 160 m/min. or 200 m/min., using hot plates at 90° C., at such stretching ratios that will give stretched yarns having equal strengths and elongations. Then, the stretchability, and the occurrence of filament breakage at the start of and during the stretching operation were examined for each tow. The results are shown in Table 2.

Table 2

| | | Stretching speed, 160 m/min. | | Stretching speed, 200 m/min. | |
|---|---|---|---|---|---|
| Sample | Stretch ratio (times) | Filament breakage at the start of stretching | Filament breakage during stretching | Filament breakage at the start of stretching | Filament breakage during stretching |
| A | 3.70 | Comparatively little | Much | Much | Much |
| B | 3.00 | Comparatively little | Comparatively much | Medium | Much |

Table 2-continued

| Sample | Stretch ratio (times) | Stretching speed, 160 m/min. Filament breakage at the start of stretching | Stretching speed, 160 m/min. Filament breakage during stretching | Stretching speed, 200 m/min. Filament breakage at the start of stretching | Stretching speed, 200 m/min. Filament breakage during stretching |
|---|---|---|---|---|---|
| C | 2.50 | No | No | No | No |
| D | 2.20 | No | No | No | No |
| E | 2.00 | No | No | No | No |
| F | 1.80 | No | No | No | No |

As apparent from Table 2, the conventional tow generally in use (Sample A) generated filament breakage at a high speed as 160 m/min. or 200 m/min., at the start of the stretching operation by the sharp change of the tension, and generated much filament breakage also during the stretching operation. Therefore, it was impossible to obtain fibers of commercial merit. In the case of the polyester tow (sample B) representing a higher birefringence than the generally used ones but representing a lower birefringence than the lower limit (0.020) specified in the present invention, there were also similar troubles in stretching as in the generally used polyester tows. In contrast thereto, the tows composed of the highly oriented unstretched yarns according to the present invention (Samples C to F) were completely exempted from filament breakage at the start of and during the stretching operation even by such high speed stretching, giving high quality stretched yarn, which was faultless and perfect from the commercial viewpoint.

EXAMPLE 2

When the stretching temperature in Example 1 was changed from 90° C. to 150° C., Samples A and B which did not pertain to the present invention experienced an excess load to make stretching impossible by the fusing of the filaments on the hot plates. In contrast thereto, Samples C to F pertaining to the present invention represented fully satisfactory stretchability, and there was no filament breakage at the start of or during the stretching operation.

EXAMPLE 3

The unstretched Samples C to F in Example 1 were bundled to form a tow of 500 thousand deniers, respectively. These tows were stretched at various stretching ratios, using hot plates at 150° C. to examine the stretchability. The results are shown in Table 3. All these unstretched Samples C to F were those satisfying the birefringence specified in the present invention. The stretching ratios specified in the present invention were 2.09 - 2.86 for Sample C, 1.89 - 2.56 for Sample D, 1.70 - 2.59 for Sample E, and 1.62 - 2.16 for Sample F, respectively.

As apparent from Table 3, in all cases in which stretching was carried out within the range of the stretching ratios specified in the present invention, the stretchability was good, with no filament breakage or unstretched residual parts being generated, and high quality stretched yarn, faultless and perfect from the commercial viewpoint, was obtained. But when stretching was carried out outside the range of the stretching ratios specified in the present invention, unstretched residual parts occurred at the lower stretching ratio side, and much filament breakage occurred at the higher stretching ratio side, and therefore it was impossible to obtain a stretched yarn of commercial merit.

Table 3

| Sample | C | D | E | F |
|---|---|---|---|---|
| Stretch ratio (times) | | | | |
| 1.5 | Much occurrence of unstretched residual parts | Much occurrence of unstretched residual parts | Much occurrence of unstretched residual parts | Much occurrence of unstretched residual parts |
| 1.6 | Much occurrence of unstretched residual parts | Much occurrence of unstretched residual parts | Much occurrence of unstretched residual parts | Fairly much occurrence of unstretched residual parts |
| 1.8 | Much occurrence of unstretched residual parts | Some occurrence of unstretched residual parts | Good | Good |
| 2.0 | Some occurrence of unstretched residual parts | Good | Good | Good |
| 2.2 | Good | Good | Good | Some filament breakage |
| 2.4 | Good | Good | Some filament breakage | Much filament breakage |
| 2.6 | Good | Some filament breakage | Much filament breakage | Stretching impossible |
| 2.8 | Good | Much filament breakage | Stretching impossible | Stretching impossible |
| 3.0 | Some filament breakage | Stretching impossible | Stretching impossible | Stretching impossible |

EXAMPLE 4

The unstretched Sample F of Example 1 was bundled into the form of a 700 thousand denier tow. The tow was stretched at the stretching ratio of 1.9 times and at the stretching speed of 250 m/min., in steam at 150° C. jetted against it from a steam jet slit provided so as to traverse the travelling direction of the tow. The tow was then heat-treated by passing it through a slit between hot plates at 180° C. for a length of 5 meters. Thereafter, this stretched tow was mechanically crimped, heat set, oiled and cut. The polyester staple fibers thus obtained had a tenacity of 4.70 g/d., an elongation of 24.5%, and a percent shrinkage by dry heat of 1.2%. Therefore, the fibers were quite satisfactory as staple fibers for spun yarn.

What we claim is:

1. A process for the production of polyster fiber, which comprises melt-spinning a polyethylene terephthalate to form oriented filaments such that the birefringence $\Delta n$ of the unstretched filaments after spinning is 0.020 to 0.100, bundling the resulting filaments into the form of a tow of at least several tens $\times$ 10,000 deniers, and subjecting the tow to stretching at a temperature greater than 100° C and at a stretch ratio satisfying the formula $$-1.58\log(\Delta n \times 10^3) + 4.18 \leqq DR \leqq -2.32\log(\Delta n \times 10^3) + 5.93$$

wherein $\Delta n$ represents the birefringence of the unstretched filaments and DR represents the stretch ratio, the tow takeup speed after stretching being greater than 150 m/min.

2. A process as claimed in claim 1 wherein the tow is a tow of at least 500,000 deniers.

3. A process as claimed in claim 1 wherein the melt-spinning is conducted at a speed of at least 2,000 m/min.

4. A process as claimed in claim 1 wherein the tow takeup speed is greater than 180 m/min.

5. A process as claimed in claim 4 wherein the tow takeup speed is greater than 200 m/min.

6. A process as claimed in claim 5 wherein the tow takeup speed is greater than 200 m/min. and up to about 500 – 600 m/min.

7. A process as claimed in claim 1 wherein the birefringence Δn of the unstretched filaments is 0.025 – 0.070.

8. A process as claimed in claim 1 wherein the polyethylene terephthalate to be melt-spun has an intrinsic viscosity of about 0.35 – 0.70 as measured at 30° C. in a mixed solvent of phenol and tetrachloroethane in the ratio of 6:4.

9. A process as claimed in claim 1 wherein the stretching is conducted in one stage at a temperature of 120°– 230° C by means of a steam jet and hot plate.

10. A process as claimed in claim 1 wherein the stretching is conducted in one stage and in the presence of at least one member selected from the group consisting of a hot plate, steam and a hot air current.

11. A process for the production of polyester fiber which comprises melt-spinning a polyethylene terephthalate having an intrinsic viscosity of 0.35 – 0.70, as measured at 30° C. in a mixed solvent of phenol and tetrachloroethane in the ratio of 6:4, to form oriented filaments such that the birefringence Δn of the unstretched filaments after spinning is 0.025 – 0.070, bundling the filaments into the form of a tow of 500,000 – 1,000,000 deniers, and subjecting the tow to stretching at a temperature of 120° – 230° C. and at a stretch ratio satisfying the formula $$-1.58\log(\Delta n \times 10^3) + 4.18 \leqq DR \leqq -2.32\log(\Delta n \times 10^3) + 5.93$$

wherein Δn represents the birefringence of the unstretched filaments and DR represents the stretch ratio, the tow takeup speed after stretching being 180 – 600 m/min.

12. A process as claimed in claim 11 wherein the stretching is conducted in one stage and in the presence of at least one member selected from the group consisting of a hot plate, steam and a hot air current.

* * * * *